US008827410B2

(12) United States Patent
Sheflin et al.

(10) Patent No.: US 8,827,410 B2
(45) Date of Patent: Sep. 9, 2014

(54) METHOD AND APPARATUS FOR CLEANING A HEATED DRUM WITHIN A CONTINUOUS WEB PRINTER

(75) Inventors: Joseph C. Sheflin, Macedon, NY (US); Michael J. Levy, Webster, NY (US); Jason M. LeFevre, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 167 days.

(21) Appl. No.: 13/464,364

(22) Filed: May 4, 2012

(65) Prior Publication Data

US 2013/0293648 A1 Nov. 7, 2013

(51) Int. Cl.

| | |
|---|---|
| ***B41J 29/38*** | (2006.01) |
| *B41J 2/01* | (2006.01) |
| *B41J 2/165* | (2006.01) |
| *B41J 2/175* | (2006.01) |
| *B41F 35/00* | (2006.01) |
| *G03G 21/00* | (2006.01) |
| *G03G 15/00* | (2006.01) |
| *G03G 15/10* | (2006.01) |
| *G03G 15/20* | (2006.01) |
| *G03G 15/30* | (2006.01) |

(52) U.S. Cl.

USPC ..... 347/17; 347/16; 347/29; 347/32; 347/33; 347/88; 347/102; 347/103; 347/104; 101/423; 101/424; 101/424.1; 101/424.2; 101/425; 399/34; 399/71; 399/123; 399/149; 399/326; 399/327; 399/343; 399/345

(58) Field of Classification Search

CPC ..... B41J 29/17; B41F 23/002; B41F 35/00; G03G 15/161; G03G 15/168; G03G 15/166; G03G 15/2025; G03G 15/2075; G03G 21/00; G03G 21/169; G03G 2215/00531; G03G 2215/0431; G03G 2215/043

USPC ..... 347/16, 17, 29, 32, 33, 88, 101, 102, 347/103, 104; 101/423, 424, 424.1, 424.2, 101/425; 399/34, 71, 123, 149, 245, 326, 399/327, 343, 345

See application file for complete search history.

(56) References Cited

U.S. PATENT DOCUMENTS

| | | | | |
|---|---|---|---|---|
| 4,867,064 | A | 9/1989 | Hara et al. | |
| 5,367,955 | A | 11/1994 | Hara et al. | |
| 5,678,157 | A | 10/1997 | Yoshida et al. | |
| 5,966,157 | A * | 10/1999 | Dolan | 347/103 |
| 6,229,968 | B1 * | 5/2001 | Martin et al. | 399/34 |
| 6,698,878 | B1 * | 3/2004 | Roche et al. | 347/104 |
| 6,767,092 | B2 | 7/2004 | May et al. | |
| 6,876,832 | B2 | 4/2005 | Pirwitz et al. | |
| 7,391,984 | B2 * | 6/2008 | Sugita et al. | 399/69 |
| 7,438,288 | B2 * | 10/2008 | Nishiberi et al. | 271/256 |

(Continued)

*Primary Examiner* — Laura Martin
*Assistant Examiner* — Jeremy Bishop
(74) *Attorney, Agent, or Firm* — Maginot, Moore & Beck, LLP

(57) ABSTRACT

A method of cleaning a heated drum within a continuous web printer includes operating an actuator to rotate a drum that is heated to a first temperature. The drum rotates in a process direction of a media web contacting the drum and heats the media web as the media web moves over a portion of the drum. The method also includes stopping movement of the media web, heating the drum to a second temperature that is greater than the first temperature, and operating the actuator to rotate the drum against a portion of the stopped media web to transfer ink from the drum to the portion of the stopped media web.

20 Claims, 5 Drawing Sheets

(56) References Cited

U.S. PATENT DOCUMENTS

| | | | | |
|---|---|---|---|---|
| 7,512,368 | B2 | 3/2009 | Zess et al. | |
| 7,832,852 | B2 | 11/2010 | Leighton et al. | |
| 7,957,686 | B2 * | 6/2011 | Shida | 399/327 |
| 7,971,987 | B2 | 7/2011 | Godil et al. | |
| 8,162,469 | B2 * | 4/2012 | Rea et al. | 347/102 |
| 8,579,406 | B2 * | 11/2013 | Buchar et al. | 347/19 |
| 2001/0055047 | A1 | 12/2001 | Ohsawa et al. | |
| 2005/0158087 | A1 | 7/2005 | Jones et al. | |
| 2006/0045581 | A1 | 3/2006 | Eck et al. | |
| 2007/0199458 | A1 | 8/2007 | Cyman, Jr. et al. | |
| 2007/0218195 | A1 | 9/2007 | Pickering et al. | |
| 2010/0033532 | A1 | 2/2010 | Frazier et al. | |
| 2010/0045720 | A1 | 2/2010 | Williams et al. | |

* cited by examiner

METHOD AND APPARATUS FOR CLEANING A HEATED DRUM WITHIN A CONTINUOUS WEB PRINTER

TECHNICAL FIELD

The system described below relates to imaging devices that produce ink images on a continuous web of media, and, more particularly, to cleaning accumulated ink off surfaces within the imaging devices.

BACKGROUND

In general, inkjet printing machines, also known as imaging devices or printers, include at least one printhead that ejects drops of liquid ink either directly onto recording media or onto an ink image receiving surface for transfer to recording media. A phase change inkjet printer employs phase change inks that are in the solid phase at ambient temperature, but they transition to a liquid at an elevated temperature. The melted ink is then ejected as ink drops by a printhead to form an ink image.

One type of inkjet printer is a continuous web printer. In this type of printer, a media web is unwound from a supply roller and directed through a feed path that passes by one or more printheads for formation of an ink image directly onto the sheet. The continuous web is pulled through the printer by driven rollers. Tension is maintained on the web to enable movement of the web by moveable tension bars or rollers, which remove slack from the web so the web remains taut without breaking.

Regardless of the type of media, proper image durability and quality is achieved by heating the media both prior to printing and fixing the ink image onto the web. In web-fed printers, media heaters typically comprise one or more radiant heaters positioned along the media pathway for exposing the media to a sufficient amount of thermal energy to regulate the temperature of the moving web. Thermal output of the radiant heaters is controlled by adjusting the power supplied to the heaters. The printing system typically includes a thermal sensor positioned adjacent the media pathway to detect the temperature of the moving web and provide the detected temperatures to a controller. The controller can then adjust the electrical power provided to the heaters with reference to the detected temperatures of the web to adjust the temperature of the media web.

A schematic diagram for a typical continuous web printer that includes multiple printheads that eject melted phase change ink on the moving web to form an ink image on the web is illustrated in FIG. 5. The solid ink printer, hereafter simply referred to as a printer 110, implements a solid ink print process for printing onto a continuous media web. To this end, the printer 110 includes a web supply and handling system 160, a phase change ink printing system 114, and a web heating system 120.

The web supply and handling system 160 can include one or more media supply rolls 138 for supplying a media web 112 to the printer 110. The supply and handling system 160 is configured to feed the media web 112 in a process direction 130 in a known manner along a media pathway in the printer 110 through the print zone 118, and past the web heating system 120 and fixing assembly 150. To this end, the supply and handling system 160 can include any suitable arrangement of components 164, such as rollers, idler rollers, tensioning bars, etc., for moving the media web 112 through the printer 110. The web supply and handling system 160 can include a take-up roller 139 for receiving the media web 112 after printing operations have been performed.

The phase change ink printing system 114 includes a plurality of printhead assemblies, which are appropriately supported to enable one or more printheads within these assemblies to eject drops of ink directly onto the media web 112 as the web moves through the print zone 118. The printing system 114 can be incorporated into either a carriage type printer, a partial width array type printer, or a page-width type printer.

Ink is supplied to the printhead assemblies within the printing system 114 from a solid ink supply (not shown). Since the phase change ink printer 110 is a multicolor device, the ink supply includes multiple sources of different colors of phase change solid ink. The phase change ink system also includes a solid phase change ink melting assembly (not shown) for at least each color of ink to melt and deliver liquid ink to one of the printhead assemblies in the printing system 114. The liquid ink is supplied to one or more printheads in a printhead assembly by gravity, pump action, or both.

Once the drops of ink have been ejected by the printing system 114 onto the moving media web 112 to form an ink image, the media web 112 is moved through a fixing assembly 150 which spreads the ink enabling proper image durability and quality. In the embodiment of FIG. 5, the fixing assembly 150 comprises at least one pair of fixing rollers 154 that are positioned in relation to each other to form a nip through which the media web 112 is fed. The ink drops on the media web 112 are pressed into the web 112 and spread on the web 112 by the pressure formed by the nip. Although the fixing assembly 150 is depicted as a pair of fixing rollers, the fixing assembly 150 can be any suitable type of device or apparatus, as is known in the art, which is capable of fixing the image to the media web 112.

Operation and control of the various subsystems, components, and functions of the printer 110 are performed with the aid of a controller (not shown in FIG. 5). The controller can be implemented as hardware, software, firmware, or any combination thereof. In one embodiment, the controller comprises a self-contained, microcomputer having a central processor unit and electronic storage as is known in the art. The controller is configured to coordinate the operation of the systems within the printer to produce printed ink images on media that correspond to image data received from one or more image data sources.

In the embodiment of FIG. 5, the web heating system 120 includes heaters integrated into a preheating drum 124 and a leveler roller 126. Additionally, radiant heaters 128 are also positioned along the feed path for regulation of the web temperature. Such heated rollers and radiant heaters are known in the art. The preheating drum 124 is positioned upstream from the printing system 114 to heat the portion of the media web 112 opposite the drum 124 prior to that portion of the web reaching the print zone 118. This media heating facilitates the ink adhesion to the web 112 as well as secondary color mixing. The leveler roller 126 is positioned downstream from the printing system 114 to heat the media web 112 after ink has been applied to the media web 112 to help the different layers of ink on the media web 112 reach a uniform temperature. The radiant heaters 128 are positioned downstream from the printing system 114 and the leveler roller 126 in order to heat the media web 112 to a temperature appropriate for fixing the ink image to the web 112 at the fixing assembly 150.

The web heating system 120 can be configured to heat the media web 112 to any suitable temperature dependent upon a number of factors including web speed, web type, ink type, position along the media pathway, etc. For example, the web heating system 120 can be configured to heat the media web 112 to approximately 55 degrees Celsius at the preheating drum 124 prior to printing to the web. The web heating system 120 can also be configured to heat the media web 112 to approximately 30 degrees Celsius at the leveler roller 126.

Ink sometimes escapes from the printhead assemblies in the printing system 114 and migrates to the surface of the preheating drum 124 or the leveler roller 126. Even the intermittent release of melted ink onto one or both of these rollers can accumulate to a level capable of producing defects on prints by interfering with the movement of the media web 112 about the preheating drum 124 and/or the leveler roller 126. Manually cleaning accumulated ink from the preheating drum 124 or leveler roller 126 is a time consuming and labor intensive process because features within the printer 110 are difficult to access without dismantling at least part of the printer 110. Additionally, the printer 110 cannot be used to generate printed images when the drum 124 or the leveler 126 is manually cleaned. Accordingly, a process for cleaning ink off the preheating drum 124 and/or the leveler roller 126 that minimally interferes with use of the printer is desirable.

SUMMARY

A method of cleaning a heated drum within a continuous web printer has been developed. The method includes operating an actuator to rotate a drum heated to a first temperature, stopping movement of the media web, heating the drum to a second temperature that is greater than the first temperature, and operating the actuator to rotate the drum against a portion of the stopped media web to transfer ink from the drum to the portion of the stopped media web. The drum rotates in a process direction of a media web and the drum contacts the media web to heat the media web as the media web moves over a portion of the drum.

A continuous web printer configured to clean a heated drum within the continuous web printer has been developed. The continuous web printer includes a first actuator, a drum, a heater, a second actuator, and a controller. The first actuator is operatively connected to and configured to rotate the drum. The heater is configured to heat the drum. The second actuator is operatively connected to a roller to move a continuous media web through the continuous web printer. The controller is operatively connected to the first actuator, the heater, and the second actuator. The controller is configured to operate the heater to heat the drum to a first temperature, to operate the first actuator and the second actuator to rotate the drum while the drum is heated to the first temperature and move the continuous media web through the continuous web printer to enable ink image formation on the continuous media web, to stop the second actuator and movement of the continuous media web through the continuous web printer, to operate the heater to heat the drum to a second temperature that is greater than the first temperature, and to operate the first actuator to rotate the drum against a portion of the stopped continuous media web to transfer ink from the drum to the portion of the stopped continuous media web.

DETAILED DESCRIPTION

Figure 1:
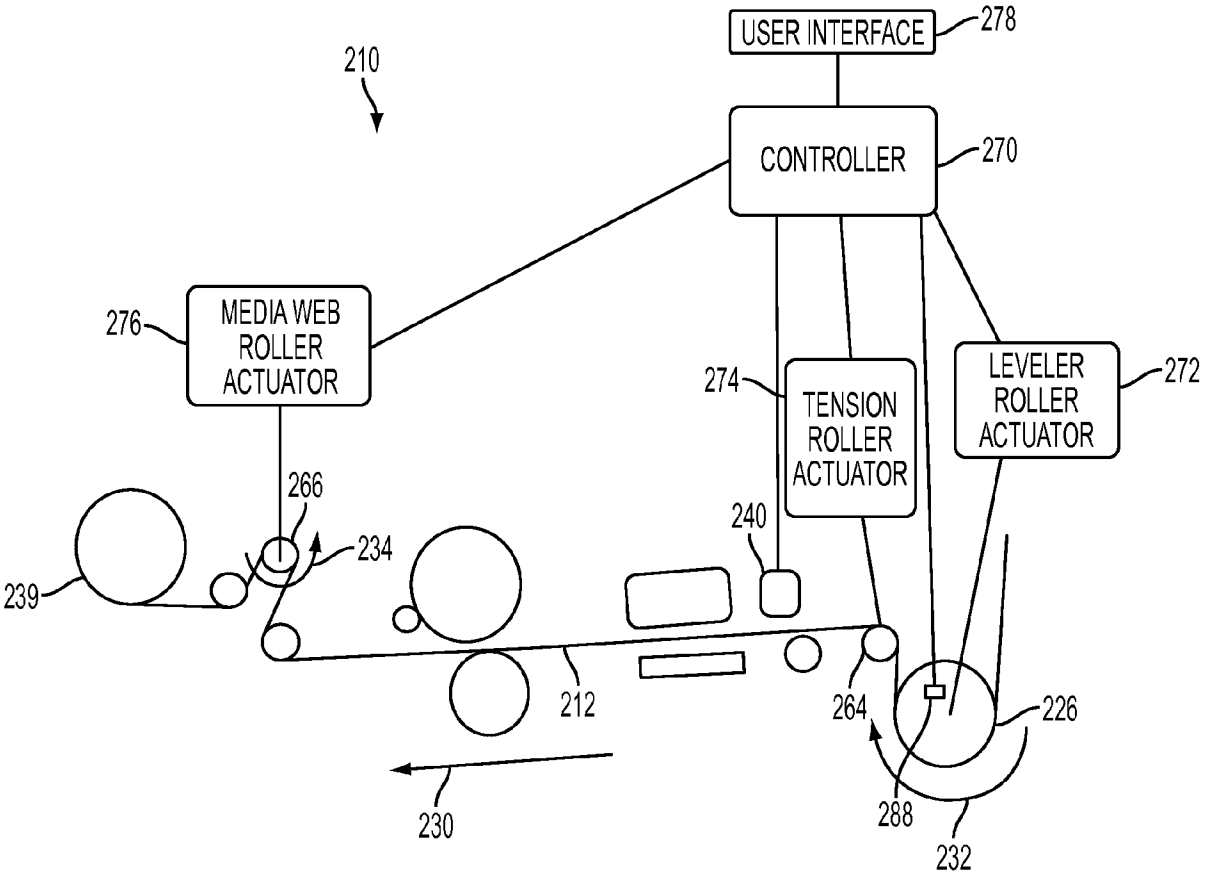
FIG. 1 is a schematic diagram of the portion of a phase change imaging device for printing onto a continuous media web that is downstream from the print zone.
Figure 5:
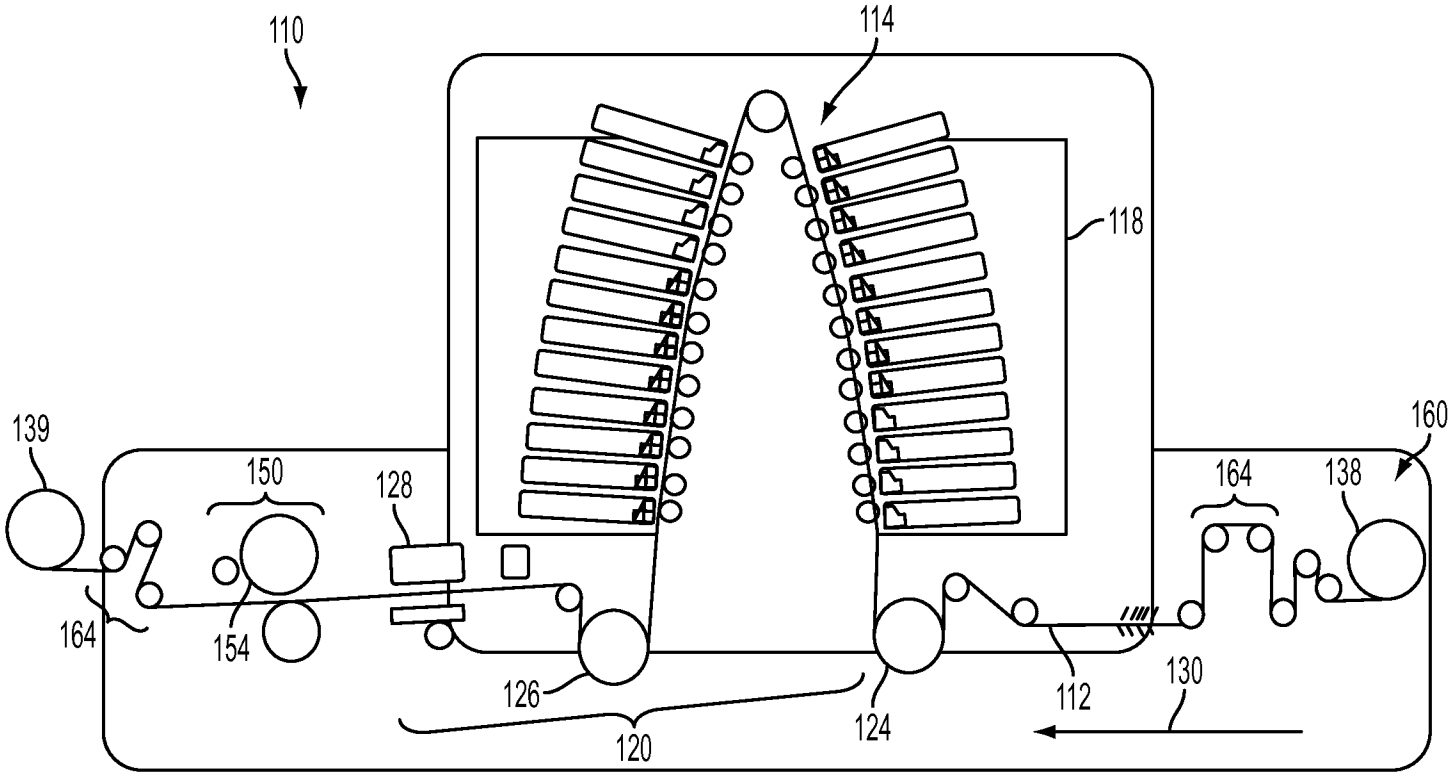
FIG. 5 depicts a typical phase change imaging device for printing onto a continuous media web.

FIG. 1 depicts a portion 210 of a phase change printer that follows the printing system 114 of the printer 110 shown in FIG. 5. Portion 210 includes a leveler roller 226, a leveler roller actuator 272, a tension roller 264, a tension roller actuator 274, an optical sensor 240, a media web roller 266, a media web roller actuator 276, a user interface 278, and a controller 270. The controller 270 is operatively connected to the user interface 278 to enable the controller to receive input signals that identify printer operations to be regulated by the controller 270 and the parameters by which the controller operates the components implementing the identified operation. The controller 270 is also operatively connected to the leveler roller actuator 272, the tension roller actuator 274, the optical sensor 240, and the media web roller actuator 276 to enable the controller 270 to generate and deliver control signals to the actuators to control the rotation and/or position of the rollers and to enable receipt of image data signals that correspond to the surface of the web 212 opposite the optical sensor 240. Additionally, the controller 270 is operatively connected to a heater 278 to adjust the temperature of the leveler roller 226. The controller 270 can selectively couple electrical power through a switch to adjust the temperature of the leveler roller 226 to a predetermined set point.

The leveler roller 226 engages the media web 212 after an ink image has been formed on the media web 212 and heats the media web 212 to bring the different layers of ink on the media web 212 to a uniform temperature. The leveler roller actuator 272 is operatively connected to the leveler roller 226 to rotate the leveler roller 226 in a clockwise direction 232 to move the media web 212 around the leveler roller 226 and through the portion 210 in the process direction 230. The tension roller 264 engages the media web 212 downstream from the leveler roller 226 to maintain the appropriate amount of tension in the media web 212 through the portion 210. In the embodiment shown in FIG. 1, the tension roller 264 is located immediately downstream from the leveler roller 226. In alternative embodiments, however, the tension roller 264 can be located at other positions not immediately downstream from the leveler roller 226 that are appropriate for tension control of the web. The controller 270 selectively operates the actuator 274 to move the roller 264 to a position that applies a predetermined pressure to the web 212 between the roller 226 and the media web roller 266.

The optical sensor 240 is positioned downstream from the leveler roller 226 and generates image data of the surface of the media web 212 facing the sensor. The optical sensor 240 can be, for example, an image on web array (IOWA) sensor which includes a plurality of photoreceptors arranged in a linear array in a direction perpendicular to the process direction 230. When ink is on the media web 212, light is absorbed or scattered away from the sensor and when ink is not on the media web 212, light is reflected into the photoreceptor opposite the bare web reflecting the light. Each photoreceptor in the optical sensor 240 generates a signal having an amplitude that corresponds to the amount of reflected light received by the photoreceptor. Thus, the signals generated by the optical sensor 240 correspond to the presence or absence of ink opposite the optical sensor. The controller 270 receives these signals as image data. The controller 270 can execute programmed instructions stored in a memory operatively connected to the controller to analyze these image data.

The media web roller 266 is positioned downstream from the leveler roller 226 and engages the media web 212 to move the media web 212 through the portion 210. In the embodiment shown in FIG. 1, the media web roller 266 is positioned downstream from the optical sensor 240 and near the take-up roller 239. In an alternative embodiment, however, the media web roller 266 can be positioned in any location which enables the media web roller 266 to move the media web 212 through the portion 210 and transfer the media web 212 to the take-up roller 239. The media web roller actuator 276 is operatively connected to the media web roller 266 to rotate the media web roller 276 in a counterclockwise direction 234 to move the media web 212 around the media web roller 266 and through the portion 210 in the process direction 230. The controller 270 is operatively connected to the media web roller actuator 276 and operates the media web roller actuator 276 to move the media web roller 266 as described above.

Figure 2:
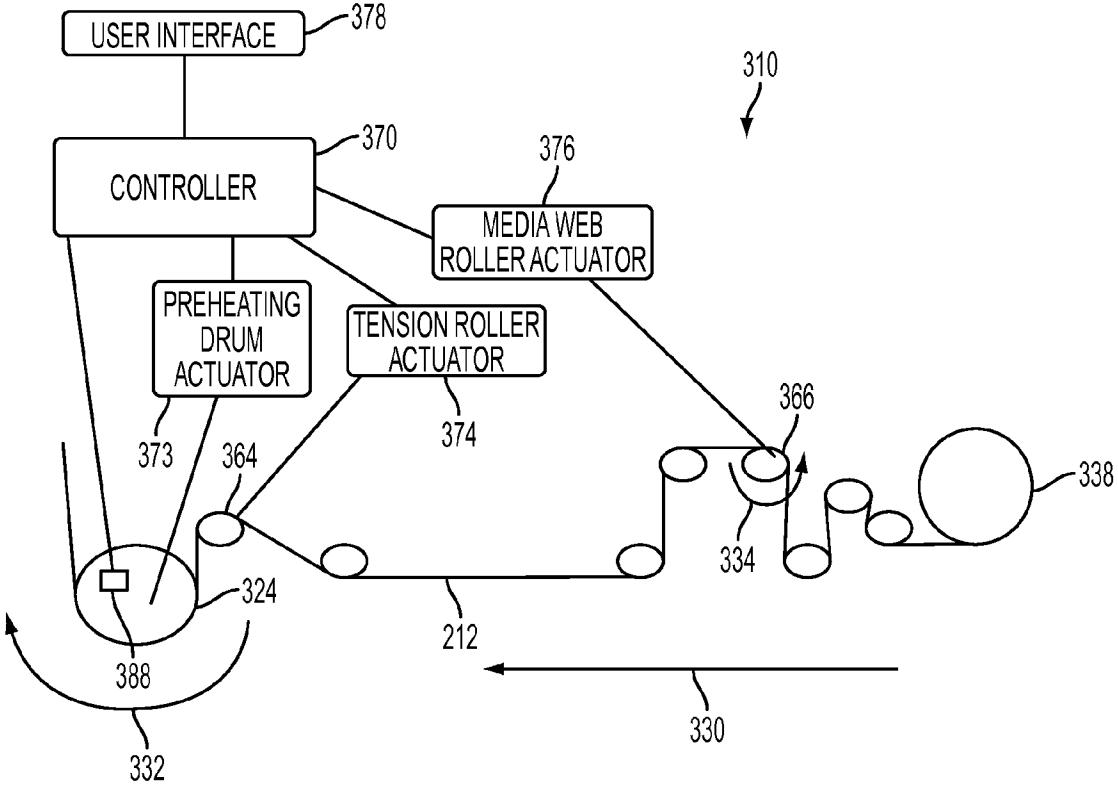
FIG. 2 is a schematic diagram of the portion of a phase change imaging device for printing onto a continuous media web that is upstream from the print zone.

FIG. 2 depicts another portion 310 of a phase change printer that is positioned upstream of the printing system 114 shown in FIG. 5. Portion 310 includes a preheating drum 324, a preheating drum actuator 373, a tension roller 364, a tension roller actuator 374, a media web roller 366, a media web roller actuator 376, a user interface 378, and a controller 370. The controller 370 is operatively connected to the user interface 278 to enable the controller to receive input signals that identify printer operations to be regulated by the controller 370 and the parameters by which the controller operates the components implementing the identified operation. The controller 370 can be independent of the controller 270 or the two controllers can be implemented with a single controller configured to perform the functions of the controller 270 described above and those of the controller 370 described below. The controller 370 is also operatively connected to the preheating drum actuator 373, the tension roller actuator 374, and the media web roller actuator 376 to enable the controller 370 to generate and deliver control signals to the actuators to control the rotation and/or position of the rollers. Additionally, the controller 370 is operatively connected to a heater 378 to adjust the temperature of the preheating drum 324. The controller 370 can selectively couple electrical power through a switch to adjust the temperature of the preheating drum to a predetermined set point.

The preheating drum 324 heats the media web 212 to a predetermined temperature before an ink image is formed on the media web 212. The preheating drum actuator 373 is operatively connected to the preheating drum 324 to rotate the drum 324 in a clockwise direction 332 to move the media web 212 around the preheating drum 324 and through the portion 310 in the process direction 330. The tension roller 364 engages the media web 212 upstream from the preheating drum 324 to maintain the appropriate amount of tension in the media web 212 through the portion 310. In the embodiment shown in FIG. 2, the tension roller 364 is located immediately upstream from the preheating drum 324. In alternative embodiments, however, the tension roller 364 can be located at other positions not immediately upstream from the preheating drum 324 that are appropriate for tension control of the web. The controller 370 selectively operates the actuator 374 to move the tension roller 364 to a position that applies a predetermined pressure to the web 212 between the drum 324 and the media web roller 366.

The media web roller 366 is positioned upstream from the preheating drum 324 and engages the media web 212 to move the media web 212 through the portion 310. In the embodiment shown in FIG. 2, the media web roller 366 is positioned upstream from the tension roller 364 and near the media supply roller 338. In an alternative embodiment, however, the media web roller 366 can be positioned in any location which enables the media web roller 366 to remove the media web 212 from the media supply roller 338 and through the portion 310. The media web roller actuator 376 is operatively connected to the media web roller 366 to rotate the media web roller 366 in a counterclockwise direction 334 to move the media web 212 around the media web roller 366 and through the portion 310 in the process direction 330. The controller 370 is operatively connected to the media web roller actuator 376 and operates the media web roller actuator 376 to move the media web roller 366 as described above.

Figure 3:
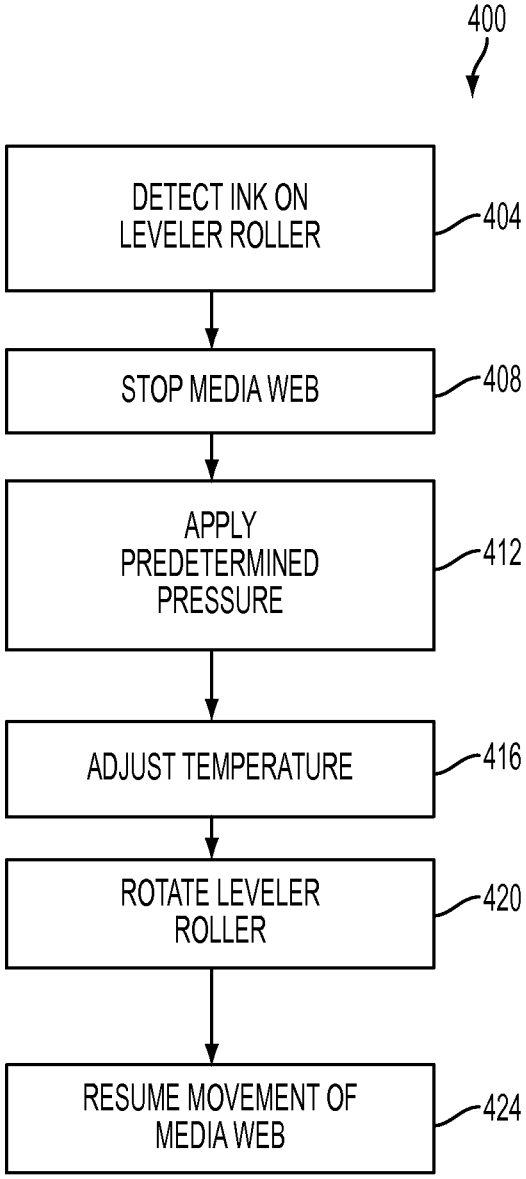
FIG. 3 is a flowchart illustrating a process for operating the portion of the phase change imaging device of FIG. 1.

As described above, ink can be unintentionally transferred to and accumulate on the surface of the preheating drum 324 (shown in FIG. 2) or the leveler roller 226 (shown in FIG. 1). An exemplary method of cleaning accumulated ink off the preheating drum 324 (shown in FIG. 2) or the leveler roller 226 (shown in FIG. 1) is depicted by the process 400 of FIG. 3. For simplicity, the process 400 is described with reference to the leveler roller 226 and the portion 210 (shown in FIG. 1) of the printer 110 (shown in FIG. 5). The same process is implemented, however, with reference to the preheating drum 324 and the portion 311 (shown in FIG. 2) of the printer 110 (shown in FIG. 5) and can be implemented simultaneously.

First, transferred ink on the leveler roller 226 is detected in one of two ways with the controller 270 (block 404). The first way that transferred ink can be detected is by a user who finds unintended ink on prints. The user then inputs information corresponding to the unintended ink into the user interface 278. The user interface 278 generates a signal indicating ink on the leveler roller 226 and sends the signal to the controller 270. The controller 270 receives the signal from the user interface 278 and acknowledges the transferred ink. The second way that transferred ink can be detected is by the optical sensor 240. Data corresponding to the intended image to be printed can be received by the controller 270. The optical sensor 240 can then generate signals that are provided to the controller 270 as image data corresponding to the actual image that was printed. These image data are analyzed by the controller 270 to detect the presence of ink in a print that was not ejected by the printing system 114 on the web 212.

In one embodiment, the controller 270 initiates a cleaning process in response to the detection of ink not ejected onto the web 212. In an alternative embodiment, the controller 270 can initiate the cleaning process periodically, regardless of the presence of transferred ink. Regardless of the method used to initiate the cleaning process, the process begins with the controller 270 operating the actuators operatively connected to the controller to stop the media web 212 from moving through the printer (block 408). The controller 270 then operates the tension roller actuator 274 to apply a predetermined pressure to the stopped media web 212 with the tension roller 264, making the media web 212 taut through the portion 210 without breaking (block 412). The controller 270 then adjusts the electrical power to the heater 278 to increase the temperature of the leveler roller 226 to a predetermined temperature that renders the ink on the leveler roller more malleable (block 416). For example, in one embodiment, the temperature of the leveler roller is raised to 80 degrees Celsius. The increased temperature of the leveler roller 226 softens the solidified accumulated ink, which causes the ink to undergo a phase transition to a semi-fluid state. The controller 270 then operates the leveler roller actuator 272 to rotate the leveler roller 226 relative to the taut, stationary media web 212 (block 420). Rotating the leveler roller 226 relative to the media web 212 causes the media web 212 to rub the surface of the leveler roller 226. The tautness of the media web 212 over the leveler roller 226 produces friction between the surface of the leveler roller 226 and the web 212 so the semi-fluid accumulated ink is rubbed off the surface of the leveler roller 226 and onto the media web 212. After all or most of the ink is transferred to the stationary web portion rubbing against the leveler roller, the controller operates the actuators operatively connected to the controller to resume movement of the web through the printer so the portion now bearing the accumulated ink is carried out of the printer (block 424).

In a similar manner, the printer portion 310 can be operated to clean accumulated ink from the pre-heating drum 324. Again with reference to FIG. 3, the process begins with the controller 370 operating the actuators operatively connected to the controller to stop the media web 212 from moving through the printer (block 408). The controller 370 then operates the tension roller actuator 374 to apply a predetermined pressure to the stopped media web 212 with the tension roller 364, making the media web 212 taut through the portion 310 without breaking (block 412). The controller 370 then adjusts the electrical power to the heater 378 to increase the temperature of the pre-heating drum 324, instead of the leveler roller 226 shown in the figure, to a predetermined temperature that renders the ink on the drum more malleable (block 416). For example, in one embodiment, the temperature of the leveler roller is raised to 80 degrees Celsius. The increased temperature of the drum 324 softens the solidified accumulated ink, which causes the ink to undergo a phase transition to a semi-fluid state. The controller 370 then operates the pre-heating drum actuator 373 to rotate the drum 324, instead of leveler roller 226, relative to the taut, stationary media web 212 (block 420). Rotating the pre-heating drum 324 relative to the media web 212 causes the media web 212 to rub the surface of the drum 324. The tautness of the media web 212 over the drum produces friction between the surface of the drum 324 and the web 212 so the semi-fluid accumulated ink is rubbed off the surface of the drum 324 and onto the media web 212. After all or most of the ink is transferred to the stationary web portion rubbing against the pre-heating drum, the controller operates the actuators operatively connected to the controller to resume movement of the web through the printer so the portion now bearing the accumulated ink is carried out of the printer (block 424).

While a printer can be configured with only one of the processes described above to clean either the leveler roller only or the pre-heating roller only, other embodiments configure two controllers or a single controller for independent implementation of the processes. In these embodiments, the controller(s) are capable of cleaning both the pre-heating roller and the leveler roller independently of one another. In yet another embodiment, the controller(s) are configured to perform the two processes simultaneously. Such an embodiment reduces the time for cleaning both the pre-heating drum and the leveler roller.

Figure 4A:
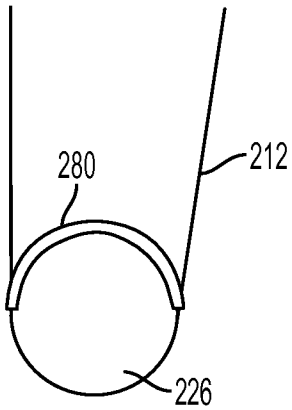
FIG. 4*a* depicts the leveler roller and media web of FIG. 1 with accumulated ink on the surface of the leveler roller.
Figure 4B:
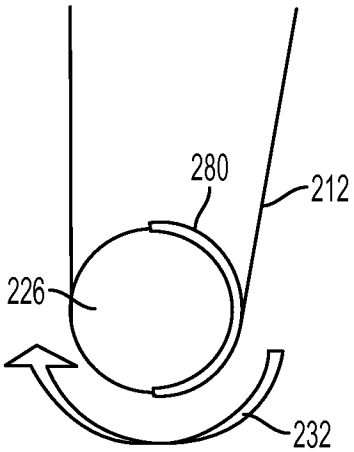
FIG. 4*b* depicts the leveler roller and media web of FIG. 1 with the accumulated ink being re-transferred from the leveler roller to the media web.
Figure 4C:
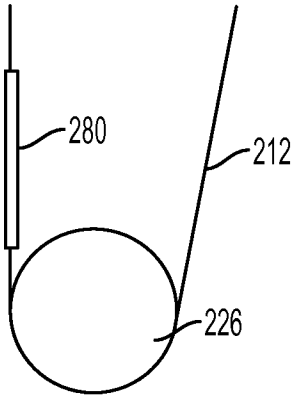
FIG. 4*c* depicts the leveler roller and media web of FIG. 1 with the accumulated ink re-transferred to the media web.

FIGS. 4*a*-4*c* depict a chronological view of the media web 212 and the leveler roller 226 during the cleaning process. FIG. 4*a* depicts the leveler roller 226 with solidified accumulated ink 280 on the surface of the leveler roller 226. FIG. 4*b* depicts the leveler roller 226 heated to the increased temperature and moving in a clockwise direction 232 relative to the taut, stationary media web 212. As shown in FIG. 4*b*, the semi-fluid accumulated ink 280 is transferred to the media web 212 as the leveler roller 226 rotates. FIG. 4*c* depicts the leveler roller 226 after the accumulated ink 280 has been transferred from the surface of the leveler roller 226 to the media web 212 and the web has resumed movement to remove the accumulated ink from the printer.

Referring again to FIG. 1, the controller 270 concludes the cleaning process by readjusting the temperature of the leveler roller 226 to a predetermined printing operational temperature, which is one embodiment is 30 degrees Celsius. The controller 270 then operates the tension roller actuator 274 to apply less pressure to the media web 212 with the tension roller 264 and operates the media web roller actuator 276 to rotate the media web roller 266 to move the media web through the portion 210 in the process direction 230. The portion of the media web 212 bearing the accumulated ink is then transferred to the take-up roller 239.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of cleaning a heated drum within a continuous web printer, the method comprising:

operating a first actuator to rotate a drum heated to a first temperature, the drum rotating in a process direction of a media web contacting the drum to heat the media web as the media web moves over a portion of the drum;

stopping movement of the media web;

operating a second actuator operatively connected to at least one tension roller to increase a pressure applied to the stopped media web;

heating the drum to a second temperature that is greater than the first temperature; and operating the first actuator to rotate the drum against a portion of the stopped media web to transfer ink from the drum to the portion of the stopped media web.

2. The method of claim 1 further comprising:

detecting ink on the drum; and stopping movement of the media web in response to the detection of ink on the drum to enable transfer of the ink from the drum to the portion of the stopped media web.

3. The method of claim 1 wherein the drum is positioned at a location that enables the drum to contact the media web after an ink image has been formed on the media web by a plurality of inkjet ejectors.

4. The method of claim 1 wherein the drum is positioned at a location that enables the drum to contact the media web before an ink image is formed on the media web by a plurality of inkjet ejectors.

5. The method of claim 3 wherein the first temperature is approximately 30 degrees Celsius.

6. The method of claim 4 wherein the first temperature is approximately 55 degrees Celsius.

7. The method of claim 1 wherein the second temperature is at least approximately 80 degrees Celsius.

8. The method of claim 1 wherein the second temperature corresponds to a temperature at which the ink on the drum changes phase.

9. The method of claim 2, the detection of the ink on the drum further comprising:

generating image data of an ink image on the media web; and analyzing the image data of the ink image to detect ink in the ink image other than ink ejected by the plurality of inkjet ejectors to form the ink image.

10. The method of claim 1 further comprising:

operating the second actuator to reduce the pressure applied to the stopped media; and moving the media web to carry the portion of the media web to which the ink from the drum was transferred to a take-up roll.

11. A continuous web printer configured to clean a heated drum within the continuous web printer comprising:

a first actuator operatively connected to a drum and configured to rotate the drum;

a heater configured to heat the drum;

a second actuator operatively connected to at least one tension roller;

at least one other actuator operatively connected to at least one other roller to move a continuous media web through the continuous web printer; and a controller operatively connected to the first actuator, the second actuator, the heater, and the at least one other actuator, the controller being configured to operate the heater to heat the drum to a first temperature, to operate the first actuator and the at least one other actuator to rotate the drum while the drum is heated to the first temperature and move the continuous media web through the continuous web printer to enable ink image formation on the continuous media web, to stop the at least one other actuator and movement of the continuous media web through the continuous web printer, to operate the heater to heat the drum to a second temperature that is greater than the first temperature, to operate the second actuator to increase a pressure applied to the stopped continuous media web, and to operate the first actuator to rotate the drum against a portion of the stopped continuous media web to transfer ink from the drum to the portion of the stopped continuous media web.

12. The continuous web printer of claim 11 further comprising:

a user interface configured to generate a signal indicating ink on the drum; and the controller is operatively connected to the user interface to receive the signal indicative of ink on the drum and to stop the at least one other actuator and movement of the continuous media web through the continuous web printer, to operate the heater to heat the drum to a second temperature that is greater than the first temperature, and to operate the first actuator to rotate the drum against the portion of the stopped continuous media web to transfer ink from the drum to the portion of the stopped continuous media web in response to the controller receiving the signal indicative of ink on the drum from the user interface.

13. The continuous web printer of claim 11 wherein the drum is positioned at a location that enables the drum to contact the continuous media web after an ink image has been formed on the continuous media web by a plurality of inkjet ejectors in the continuous web printer.

14. The continuous web printer of claim 11 wherein the drum is positioned at a location that enables the drum to contact the continuous media web before an ink image is formed on the continuous media web by a plurality of inkjet ejectors in the continuous web printer.

15. The continuous web printer of claim 13 wherein the first temperature is approximately 30 degrees Celsius.

16. The continuous web printer of claim 14 wherein the first temperature is approximately 55 degrees Celsius.

17. The continuous web printer of claim 11 wherein the second temperature is at least approximately 80 degrees Celsius.

18. The continuous web printer of claim 11 wherein the second temperature corresponds to a temperature at which the ink on the drum changes phase.

19. The continuous web printer of claim 11 further comprising:

an optical sensor configured to generate image data of an ink image on the continuous media web; and the controller is operatively connected to the optical sensor and configured to analyze the image data of the ink image received from the optical sensor to detect ink in the ink image other than ink ejected by a plurality of inkjet ejectors in the continuous web printer to form the ink image on the continuous media web.

20. The continuous web printer of claim 11, the controller being further configured to operate the second actuator operatively connected to the tension roller to reduce the pressure on the continuous media web and to operate the at least one other actuator to move the continuous media web to carry the portion of the continuous media web to which the ink from the drum was transferred to a take-up roll.

* * * * *